US005746077A

United States Patent [19]

Zaccagni et al.

[11] Patent Number: 5,746,077

[45] Date of Patent: May 5, 1998

[54] ARTICLE-ROLLING MACHINE HAVING SELECTIVELY POSITIONABLE DISPENSER FOR SHEET METAL COIL

[75] Inventors: Gregory R. Zaccagni, Aurora; Joseph A. Kiely, Downers Grove, both of Ill.

[73] Assignee: ZMC, Inc., Addison, Ill.

[21] Appl. No.: 636,734

[22] Filed: Apr. 19, 1996

[51] Int. Cl.[6] ..... B21D 43/20

[52] U.S. Cl. ..... 72/183; 72/181; 242/557; 242/559; 242/595.1

[58] Field of Search ..... 72/183, 405.06, 72/250, 420, 181; 242/557, 559, 559.3, 595.1, 595, 561

[56] References Cited

U.S. PATENT DOCUMENTS

| | | | |
|---|---|---|---|
| 3,150,706 | 9/1964 | O'Brien | 72/183 |
| 3,343,393 | 9/1967 | Groll | 72/183 |
| 3,710,607 | 1/1973 | Beymer | 72/181 |
| 4,291,845 | 9/1981 | Van Cleave | 242/595.1 |
| 4,592,518 | 6/1986 | Chubb | 242/595.1 |
| 5,394,722 | 3/1995 | Meyer | 72/129 |

OTHER PUBLICATIONS

Advertising page of Grover Machine Company for Portable Gutter Machine Model PRO5–K, undated, admitted prior art.

Advertising page of Redi–Built Products for Knutson KR–18 Portable Heavy Duty Panel Manufacturing System, undated, admitted prior art.

Advertising page of Roll Former Corporation for (lower item) Decoiler, undated, admitted prior art.

*Primary Examiner*—Daniel C. Crane

*Attorney, Agent, or Firm*—Dressler, Rockey, Milnamow & Katz, Ltd.

[57] ABSTRACT

A machine for rolling an article, such as a rain gutter, from sheet metal dispensed from a coil comprises an elongate base having an input end, at which sheet metal dispensed from a coil is inputted into the machine, and an outlet end, at which an article rolled by the machine is outputted from the machine. An elongate track mounted on the machine and extending between those ends includes a pair of rails extending between those ends. A dispenser for mounting a coil of sheet metal and for dispensing sheet metal from the mounted coil into the machine at the input end is supported on the elongate track, via two dispenser-supporting rollers engaging each rail, so that the dispenser can be selectively positioned on the elongate track in a loading position, near the input end of the elongate base or in a dispensing position, near the output end of the elongate base. The dispenser can be releasably secured in the dispensing position. The dispenser includes a pair of coil-supporting rollers for supporting such a coil and for enabling the supported coil to rotate about a horizontal axis defined by the coil as a strip of sheet metal is dispensed from the supported coil. A biasing roller is adapted to extend through the supported coil and is biased gravitationally for biasing a supported coil downwardly against the coil-supporting rollers.

8 Claims, 2 Drawing Sheets

FIG. 1
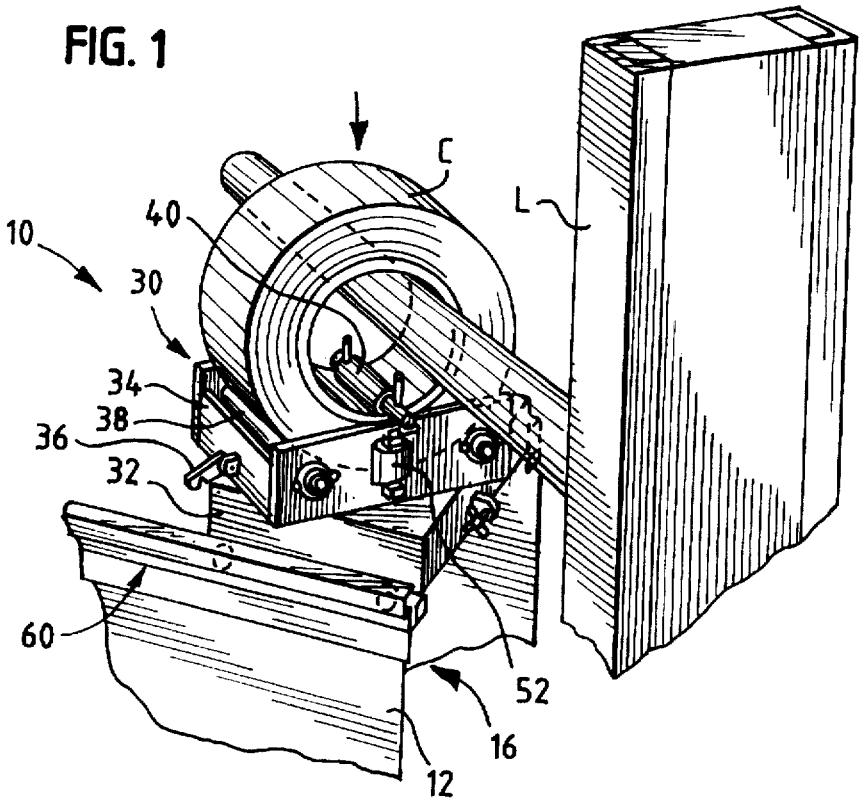
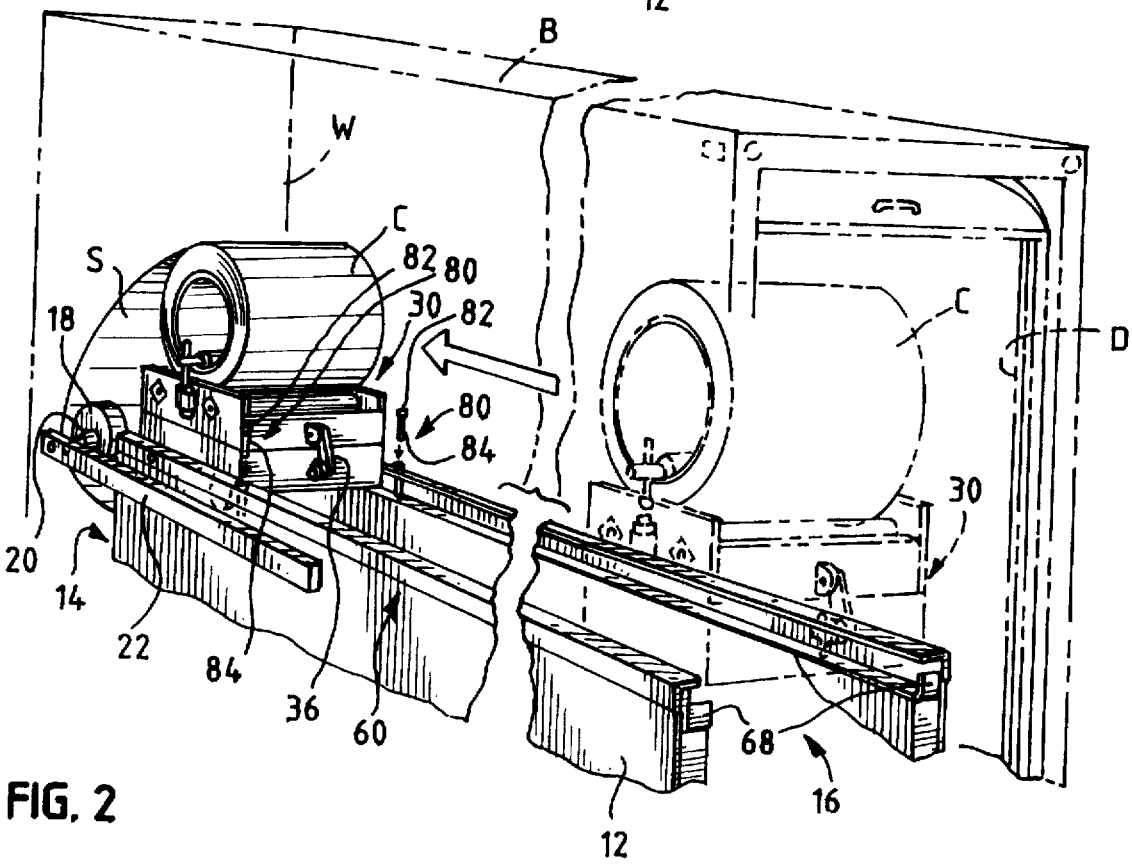
FIG. 2

FIG. 3
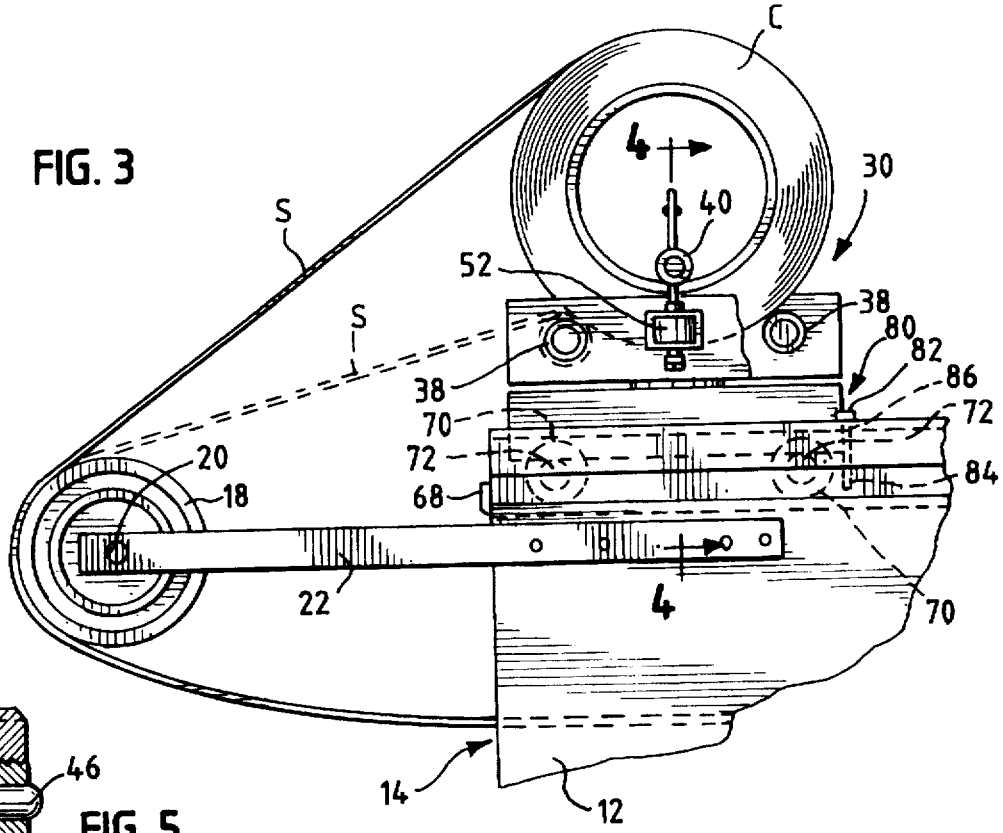
FIG. 5
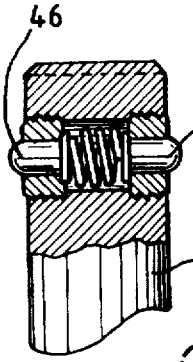
FIG. 5
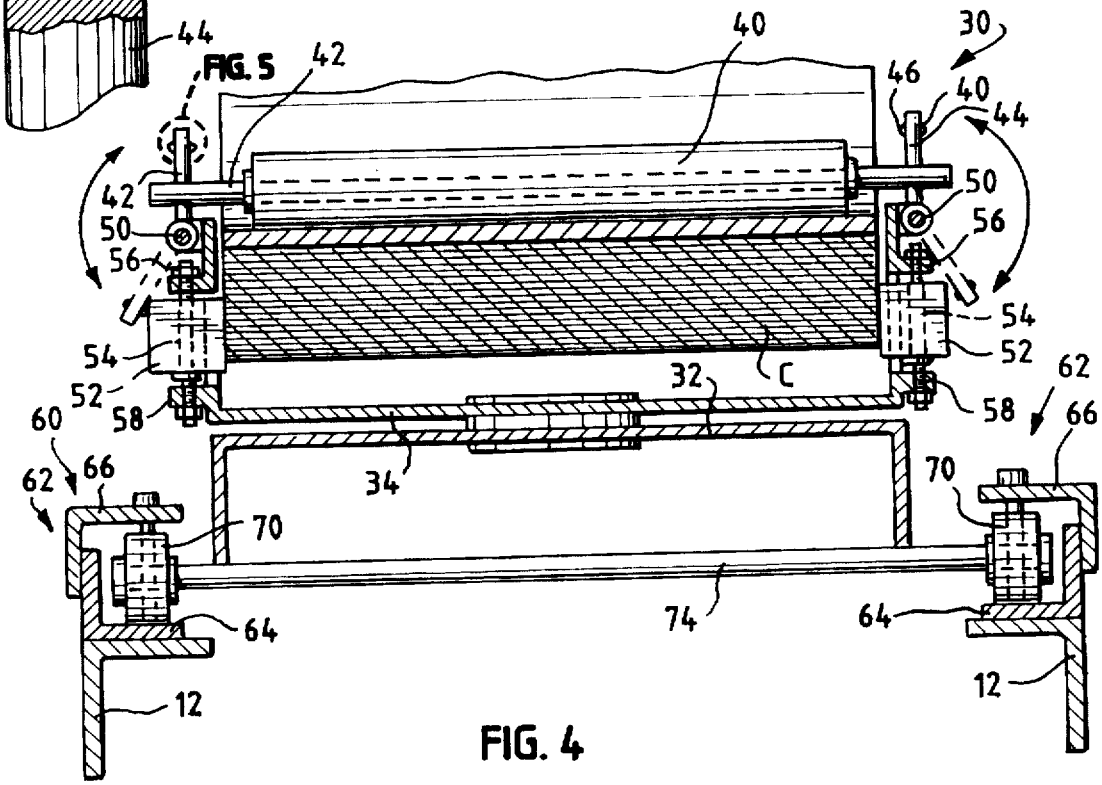
FIG. 4

ARTICLE-ROLLING MACHINE HAVING SELECTIVELY POSITIONABLE DISPENSER FOR SHEET METAL COIL

TECHNICAL FIELD OF THE INVENTION

This invention pertains to a machine of a type known heretofore and used for rolling an article, such as a rain gutter, from a strip of sheet metal dispensed from a coil. This invention contemplates, among other improvements in such a machine, that a dispenser for supporting such a coil can be selectively positioned in a loading position, near a back door of a truck body, or in a dispensing position, near a front wall of the truck body.

BACKGROUND OF THE INVENTION

Typically, a machine of the type noted above has an elongate base having an input end, at which a strip of sheet metal dispensed from a coil is inputted into the machine, and an outlet end, at which an article, such as a rain gutter or a siding panel, is outputted from the machine. Typically, a dispenser for supporting such a coil and for dispensing a strip of sheet metal from the supported coil is mounted fixedly on the elongated base, near the input end of the elongate base.

Commonly, a machine of the type noted above is mounted within a truck body, so that the machine can be easily transported from job site to job site. Usually, the machine is mounted within the truck body so that the input end of the elongate base is near a front wall of the truck body and so that the output end of the elongate base is near a back door of the truck body, whereby a rain gutter rolled by the machine can be easily withdrawn through the back door of the truck body.

Accordingly, it can be very inconvenient to load a new coil onto the dispenser, particularly if the new coil must be lifted onto the elongate base at the output end, moved along the elongate base to the dispenser at the input end, and lifted onto the dispenser. Frequently, the new coil must be manually carried along and above the elongate base, as by two workers holding a stout bar extending through the new coil. Alternatively, the new coil may be manually rolled along the elongate base, on an outer turn of the new coil. Usually, the new coil must be manually lifted onto the dispenser, as by two workers holding such a bar. It is known to use a mechanical hoist and an overhead conveyor to handle the new coil within the truck body.

A need has arisen, to which a primary aspect of this invention is addressed, for improvements enabling a coil of sheet metal to be conveniently loaded onto the dispenser of a machine of the type noted above.

SUMMARY OF THE INVENTION

According to a primary aspect of this invention, a machine of the type noted above comprises an elongate base having an input end, at which a strip of sheet metal dispensed from a coil is inputted into the machine, and an output end, at which an article, such as a rain gutter or a siding panel, is outputted from the machine. The machine further comprises means including a dispenser for supporting a coil of sheet metal and for dispensing a strip of sheet metal from the supported coil into the machine at the input end and means for mounting the dispenser so that the dispenser can be selectively positioned in a loading position, near the input end of the elongate base, or in a dispensing position, near the output end of the elongate base.

Preferably, the machine comprises an elongate track mounted on the machine and extending between the input and output ends of the elongate base. Preferably, the elongate track includes a pair of rails extending between the input and output ends of the elongate track, the mounting means comprises two pairs of dispenser-supporting rollers mounted on the dispenser, and the dispenser-supporting rollers of each pair are engaged with one of the rails so that the dispenser can be rolled along the rails, between the input and output ends of the elongate track. Preferably, moreover, the machine comprises means for securing the dispenser releasably in the dispensing position.

Preferably, the dispenser includes a pair of coil-supporting rollers for supporting a coil of sheet metal, as received by the dispenser, and for enabling the supported coil to rotate about a horizontal axis as sheet metal is dispensed from the supported coil. Preferably, moreover, the dispenser further includes means for biasing a coil of sheet metal, as supported by the coil-supporting rollers, downwardly against the coil-supporting rollers.

These and other objects, features, and advantages of this invention are evident from the following description of a preferred embodiment of this invention with reference to the accompanying drawings.

BRIEF DESCRIPTION OF THE DRAWINGS

FIG. 1 is a perspective view of a coil of sheet metal being loaded by a powered lifter onto a dispenser positioned at one end of a machine for rolling a rain gutter from a strip of sheet metal from the coil, namely the output end, at which a rain gutter rolled by the machine is outputted from the machine.

FIG. 2 is a perspective view showing the dispenser and the coil being repositioned from the output end to an input end, at which the strip is inputed into the machine.

FIG. 3 is a fragmentary, elevational view showing the strip being inputted into the machine, at the input end.

FIG. 4, on a larger scale, is a sectional view taken along line 4—4 of FIG. 3, in a direction indicated by arrows.

FIG. 5 is an enlarged, fragmentary detail of an exemplary pair of spring-biased latches of the machine, as taken in an area marked in FIG. 4.

DETAILED DESCRIPTION OF THE PREFERRED EMBODIMENT

As shown, a machine 10 of a type used for rolling a rain gutter (not shown) from a strip S of sheet metal dispensed from a coil C embodies several improvements provided by this invention, so as to constitute a preferred embodiment of this invention. Thus, among other improvements embodied in the machine 10, a dispenser 30 for supporting the coil C can be selectively positioned in a loading position or in a dispensing position.

The machine 10 has an elongate base 12 with an input end 14, at which the strip S of sheet metal dispensed from the coil C is inputted into the machine 10, and with an output end 16, at which a rain gutter rolled by the machine 10 is outputted from the machine 10. This invention enables the loading position of the dispenser 30 to be near the output end 16 of the machine, near a back door D of a truck body B, and the dispensing position of the dispenser 30 to be near the input end 14 of the machine 10, near a front wall W of the truck body B. The front wall W may not have a door permitting easy access to the input end 14 of the machine 10. Except as shown in the drawings and described herein, other structural and functional details of the machine 10 are outside the scope of this invention.

As shown in FIGS. 2 and 3, the machine 10 has a series of guiding and reversing rollers 18, which is mounted to the machine 10, at the input end 14, via a spindle 20 and two mounting arms 22 so as to be freely rotatable on the spindle 20. The guiding and reversing roller 18 guide and reverse the direction of the strip S of sheet metal from the coil C as the strip S is inputted into the machine 10.

As shown, the dispenser 30 is similar to known dispensers available commercially from Grover Machine Company of St. Louis, Mo., in that the dispenser 30 includes a lower base 32 and an upper base 34, which is mounted on the lower base 32 so as to be fully rotatable about a vertical axis. Thus, the upper base 34 can be selectively rotated to either of two rotated positions relative to the lower base 32, so as to permit the strip S to leave the coil C supported on the upper base 34 in the orientation wherein the strip S is shown in full lines in FIG. 3 or in the orientation wherein the strip S is shown in broken lines in FIG. 3.

The strip S has two expansive surfaces, which may be pre-painted in two different colors, such as white and brown. Because the upper base 34 can be selectively rotated to either of the rotated positions, a selected one of the expansive surfaces of the strip S can be thus selected to face outwardly on the rain gutter rolled by the machine 10. The dispenser 30 has known means 36 for latching the upper base 34 to the lower base 32 in either of the rotated positions.

Moreover, the dispenser 30 is similar to known dispensers discussed above in that the dispenser 30 comprises a pair of coil-supporting rollers 38, which are mounted to the upper base 34 so as to be freely rotatable, for supporting the coil C and for enabling the supported coil C to rotate about a horizontal axis defined by the supported coil C as the strip S of sheet metal is dispensed from the supported coil C. However, the dispenser 30 differs from those dispensers in that the dispenser 10 includes a biasing roller 40, which is adapted to extend through the supported coil C and which is biased gravitationally so as to bias the supported coil C downwardly against the coil-supporting rollers 38.

As shown, the biasing roller 40 is mounted on a spindle 42 so as to be freely rotatable. The spindle 42 is mounted so as to be freely and vertically movable along two vertical posts 44, one on each side of the upper base 34 whereby the biasing roller 40 is biased gravitationally so as to bias the supported coil C downwardly against the coil-supporting rollers 38. The vertical posts 44 have spring-biased latches 46, which restrain the spindle 42 and the biasing roller 40 against being unintentionally removed from the vertical posts 44 but which permit the spindle 42 and the biasing roller 40 to be intentionally removed therefrom, as when it is necessary to install a new coil. Each vertical post 44 is mounted to the upper base 34, at the lower end 48 of such vertical post 44, by a pivot mechanism 50 enabling such vertical post 44 to be downwardly pivoted away from the upper base 34, when a new coil is being installed on the dispenser 30, so as not to interfere with the new coil.

Two centering rollers 52 are mounted to the upper base 34, each below one of the vertical posts 44. Each centering roller 52 is mounted so as to be freely rotatable on a spindle 54, which is mounted to the upper base 34 via an upper flange 56 and a lower flange 58. The centering rollers 52 are employed to center the coil C supported on the coil-supporting rollers 38.

As described above, known dispensers are mounted fixedly on the gutter-rolling machines, at the lower bases. According to a significant improvement provided by this invention, however, the dispenser 30 can be selectively positioned in the loading position, near the output end 16 of the machine 10, or in the dispensing position, near the input end 14 of the machine 10. In FIG. 1, and in FIG. 2 in broken lines, the dispenser 30 is shown as positioned in the loading position. In FIG. 1, the dispenser 30 is shown as rotated partially between the rotated positions discussed above, so as to facilitate loading of the coil C onto the dispenser 30 via a powered lifter L. In FIG. 2 in full lines, and in FIGS. 3 and 4, the dispenser 30 is shown as positioned in the dispensing position.

So as to enable the dispenser 30 to be selectively positioned in the loading position or in the dispensing position, the machine 10 is equipped with an elongate track 60 comprising a pair of rails 62, one rail 62 being mounted to the machine 10 on each side of the machine 10. Moreover, the dispenser 30 is equipped with two pairs of dispenser-supporting rollers 70, each pair engaging the rail 62 on one side of the machine 10. The dispenser-supporting rollers 70 are mounted to the lower base 32 of the dispenser 30, via an input-end spindle 72 mounting one such roller 70 on each side of the machine 10 so as to be freely rotatable and an output-end roller 74 mounting one such roller 70 on each side of the machine 10 so as to be freely rotatable, so that the dispenser 30 can be manually rolled to the output end 16 of the machine 10, for loading of the coil C, or to the input end 14 of the machine 10, for dispensing of the strip S of sheet metal from the coil C.

As shown in FIG. 4 and other views, each rail 62 is fabricated from a lower angle 64, on which the dispenser-supporting rollers 70 of one pair are arranged to roll, and an upper angle 66, which is welded to the lower angle 64 and which is arranged to cover the dispenser-supporting rollers 70 arranged to roll on the lower angle 64. Each rail 62 is terminated at each end by a flange 68, which is arranged to engage the nearer such rollers 70 so as to prevent the dispenser 30 from falling from either end of the elongate track 60. Two pins 80, which have heads 82 of a relatively large diameter and shanks 84 of a relatively small diameter, are provided for securing the dispenser 30 in the dispensing position. The shanks 84 of the pins are dropped through suitably located holes 86 in the upper angles 66, on which the heads 82 of the pins 80 rest, so as to secure the dispenser 30 in the dispensing position. Similar pins (not shown) may be similarly provided for securing the dispenser 30 in the loading position.

Because the dispenser 30 can be selectively positioned in the loading position, near the back door D of the truck body B, the coil C can be conveniently loaded onto the dispenser 30. There is no need for workers to carry the coil C along and above the elongate base 12, via a bar (not shown) extending through the coil C or otherwise, or to roll the coil C along the elongate base 12.

Although the machine 10 is a machine for rolling a rain gutter, this invention may be also used in machine for rolling other articles, such as siding panels. Preferably, the coil C is a coil of sheet aluminum, which may be pre-painted. Alternatively, the coil C may be a coil of sheet copper.

Various modifications may be made in the preferred embodiment described above without departing from the scope and spirit of this invention.

We claim:

1. For a machine for rolling an article from a strip of sheet metal dispensed from a coil, in a truck body having a front wall and a back door, dispensing apparatus comprising an elongate base having an input end, which is toward the front wall of the truck body and at which a strip of sheet metal dispensed from a coil is inputted into the machine, and an output end, which is toward the back door of the truck body and at which an article rolled by the machine is outputted from the machine, means including a dispenser for supporting a coil of sheet metal and for dispensing a strip of sheet metal from the supported coil, an elongate track mounted on the machine and extending between the input and output ends of the elongate base, and means for mounting the dispenser on the elongate track so that the dispenser can be selectively positioned on the elongate track in a loading position, near the output end of the elongate base and toward the back door of the truck body, or in a dispensing position, near the input end of the elongate base and toward the front wall of the truck body.

2. For a machine for rolling an article from a strip of sheet metal dispensed from a coil, dispensing apparatus comprising an elongate base having an input end, at which a strip of sheet metal dispensed from a coil is inputted into the machine, and an output end, at which an article rolled by the machine is outputted from the machine, means including a dispenser for supporting a coil of sheet metal and for dispensing a strip of sheet metal from the supported coil, an elongate track mounted on the machine and extending between the input and output ends of the elongate base, and means for mounting the dispenser on the elongate track so that the dispenser can be selectively positioned on the elongate track in a loading position, near the output end of the elongate base, or in a dispensing position, near the input end of the elongate base, wherein the dispenser includes a pair of coil-supporting rollers for supporting a coil of sheet metal, as received by the dispenser, and for enabling the supported coil to rotate about a horizontal axis defined by the coil as a strip of sheet metal is dispensed from the supported coil and means for biasing a coil of sheet metal, as supported by the coil-supporting rollers, downwardly against the coil-supporting rollers.

3. The apparatus of claim 2 wherein the elongate track includes a pair of rails extending between the input and output ends of the elongate track, wherein the mounting means comprises two pairs of dispenser-supporting rollers mounted on the dispenser, and wherein the dispenser-supporting rollers of each pair are engaged with one of the rails so that the dispenser can be rolled along the rails, between the input and output ends of the elongate track.

4. The machine of claim 3 further comprising means for securing the dispenser releasably in the dispensing position.

5. The apparatus of claim 2 wherein the biasing means includes a biasing roller adapted to extend through a coil of sheet metal, as supported by the coil-supporting rollers, the biasing roller being biased gravitationally so as to bias the supported coil downwardly against the coil-supporting rollers.

6. For a machine for rolling an article from a strip of sheet metal dispensed from a coil, in a truck body having a front wall and a back door, coil dispensing apparatus comprising an elongate base having an input end, which is toward the front wall of the truck body and at which a strip of sheet metal is dispensed from a coil is inputted into the machine, and an output end, which is toward the back door of the truck body and at which an article rolled by the machine is outputted from the machine, means including a dispenser for supporting a coil of sheet metal and for dispensing a strip of sheet metal from the supported coil, and means for mounting the dispenser so that the dispenser can be selectively located in a loading position, near the output end of the elongate base and toward the back door of the truck body, or in a dispensing position, near the input end of the elongate base and toward the front wall of the truck body.

7. For a machine for rolling an article from sheet metal dispensed from a coil, coil dispensing apparatus comprising an elongate base having an input end, at which sheet metal dispensed from a coil is inputted into the machine, and an output end, at which an article rolled by the machine is outputted from the machine and means including a dispenser for supporting a coil of sheet metal and for dispensing sheet metal from the supported coil, and means for mounting the dispenser so that the dispenser can be selectively located in a loading position near the output end of the elongate base or in a dispensing position, near the input end of the elongate base wherein the dispenser includes a pair of coil-supporting rollers for supporting a coil of sheet metal, as received by the dispenser, and for enabling the supported coil to rotate about a horizontal axis defined by the coil as a strip of sheet metal is dispensed from the supported coil and means for biasing a coil of sheet metal, as supported by the coil-supporting rollers downwardly against the coil supporting rollers.

8. The apparatus of claim 7 wherein the biasing means includes a biasing roller adapted to extend through a coil of sheet metal, as supported by the coil-supporting rollers, the biasing roller being biased gravitationally so as to bias the supported coil downwardly against the coil-supporting rollers.

* * * * *